US006701723B1

(12) United States Patent
Dobmeier et al.

(10) Patent No.: US 6,701,723 B1
(45) Date of Patent: Mar. 9, 2004

(54) HUMIDITY CONTROL AND EFFICIENCY ENHANCEMENT IN VAPOR COMPRESSION SYSTEM

(75) Inventors: Thomas J. Dobmeier, Phoenix, NY (US); Michael F. Taras, Fayetteville, NY (US); Ruddy C. Bussjager, Cicero, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/255,882

(22) Filed: Sep. 26, 2002

(51) Int. Cl.[7] ..... F25D 17/06; F25B 27/00
(52) U.S. Cl. ..... 62/90; 62/238.6
(58) Field of Search ..... 62/90, 93, 95, 62/173, 238.6, 176.1

(56) References Cited

U.S. PATENT DOCUMENTS 3,264,840 A * 8/1966 Harnish ..... 62/173
RE26,593 E * 5/1969 Lauer ..... 62/160
5,622,057 A * 4/1997 Bussjager et al. ..... 62/173
5,651,258 A * 7/1997 Harris ..... 62/90
6,202,438 B1 * 3/2001 Barito ..... 62/513
6,381,970 B1 * 5/2002 Eber et al. ..... 62/90

* cited by examiner

*Primary Examiner*—Chen Wen Jiang
(74) *Attorney, Agent, or Firm*—Bachman & LaPointe

(57) ABSTRACT

A vapor compression system includes a vapor compression circuit including a compressor, a condenser, an expansion device and an evaporator communicated along refrigerant conveying lines; an evaporator air reheat circuit communicated with the vapor compression circuit for reheating air from the evaporator; and a refrigerant subcooling circuit communicated with the vapor compression circuit for subcooling refrigerant from the condenser, whereby humidity in the air from the evaporator can be controlled while system efficiency is maintained by the refrigerant subcooling circuit. The system further enhances system unloading capability, and part-load operation and reliability are also enhanced.

9 Claims, 4 Drawing Sheets

HUMIDITY CONTROL AND EFFICIENCY ENHANCEMENT IN VAPOR COMPRESSION SYSTEM

BACKGROUND OF THE INVENTION

The invention relates to vapor compression systems and, more particularly, to humidity control and efficiency enhancement in connection with same.

Typical vapor compression systems such as rooftop refrigeration systems and the like are widely used, and some of the chief concerns in use of such units include efficiency enhancement and humidity control.

Unfortunately, typical approaches for providing humidity control detract from compressor efficiency. Furthermore, as refrigerants evolve toward more ecologically acceptable alternatives, such alternatives tend to be less efficient.

Thus, the need exists for a vapor compression system which is both efficient and capable of humidity control.

It is therefore primary object of the present invention to provide such a system.

Other objects and advantages of the present invention will appear hereinbelow.

SUMMARY OF THE INVENTION

In accordance with the present invention, the foregoing objects and advantages have been readily attained.

According to the invention, a vapor compression system is provided which comprises a vapor compression circuit comprising a compressor, a condenser, an expansion device and an evaporator communicated along refrigerant conveying lines; an evaporator air reheat circuit communicated with said vapor compression circuit for reheating air from said evaporator; and a refrigerant subcooling circuit communicated with said vapor compression circuit for subcooling refrigerant from said condenser, whereby humidity in said air from said evaporator can be controlled while system efficiency is maintained by said refrigerant subcooling circuit.

The added efficiency in the system of the present invention which is provided by the refrigerant subcooling circuit compensates for performance degradation associated with incorporation of the evaporator air reheat circuit, which advantageously allows for over-cooling of the air to reduce humidity as desired, followed by reheat to the desired temperature.

BRIEF DESCRIPTION OF THE DRAWINGS

A detailed description of preferred embodiments of the present invention follows, with reference to the attached drawings, wherein.

DETAILED DESCRIPTION

The invention relates to vapor compression systems and, more particularly, to vapor compression systems including an economizer refrigerant subcooling circuit for enhancing system efficiency and an evaporator air reheat circuit for reheating over-cooled air from the evaporator to allow for humidity control. The enhanced efficiency of the system due to the refrigerant subcooling circuit compensates for performance degradation associated with incorporation of the evaporator air reheat circuit, thereby providing humidity control in a system with acceptable efficiency as desired in accordance with the present invention.

Furthermore, implementation of the system of the present invention advantageously allows for a higher degree of flexibility in unloading strategy enhancing part-load efficiency and system reliability.

Figure 1:
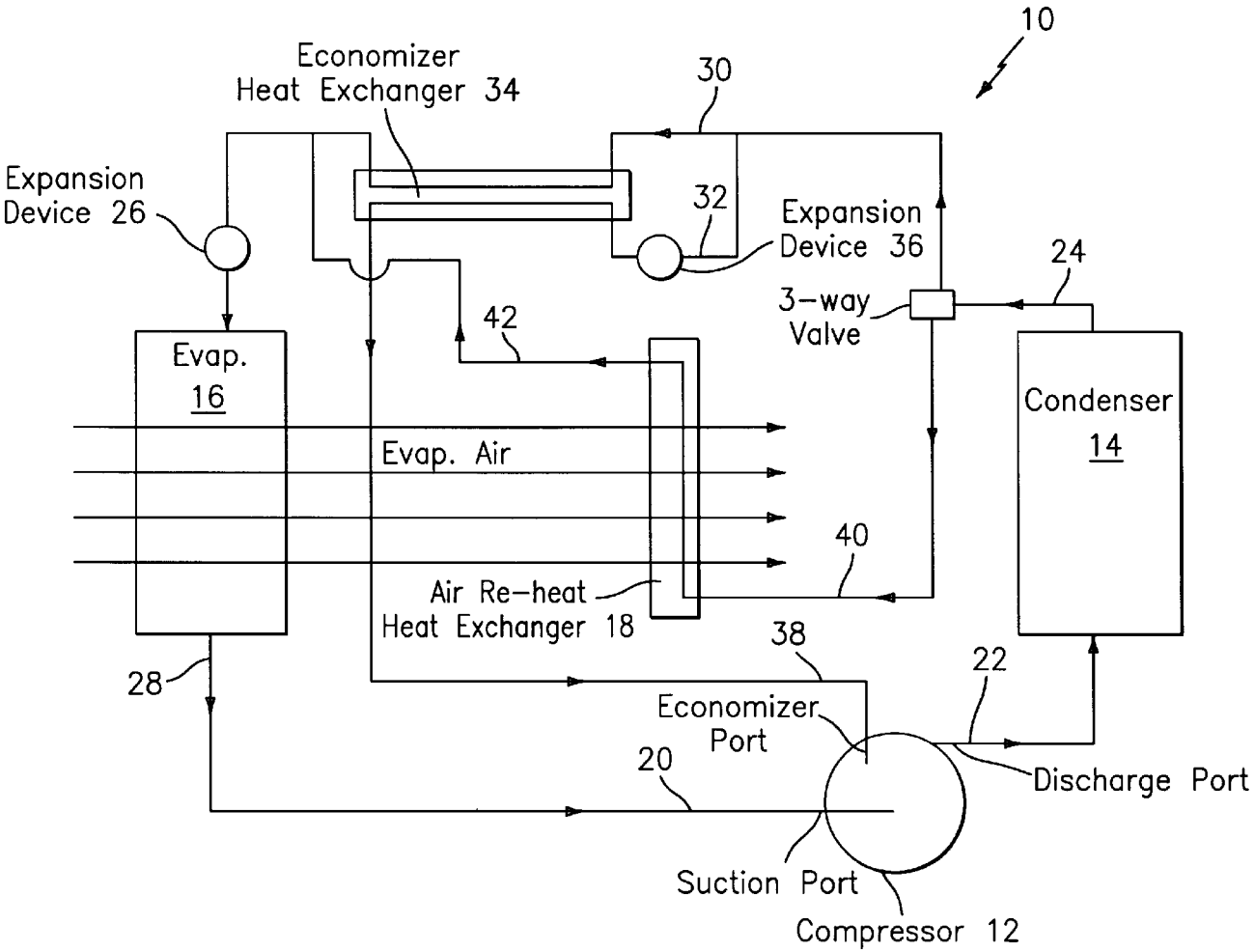
FIG. 1 schematically illustrates a system in accordance with the present invention utilizing liquid discharge from the condenser for air reheat.

Turning to FIG. 1, a vapor compression system 10 in accordance with the present invention is illustrated and includes a compressor 12, a condenser 14, an expansion device 26, and an evaporator 16 connected by refrigerant lines to operate as desired and as is well known to a person of ordinary skill in the art. As is well known, compressor 12 is fed by a refrigerant suction line 20, and discharges compressed refrigerant through discharge line 22 to condenser 14. Condenser 14 discharges liquid through discharge line 24 and ultimately through expansion device 26 to evaporator 16, wherein air is cooled and humidity or moisture removed from same. Discharge from evaporator 16 is passed through line 28 and back to compressor suction inlet 20.

In accordance with the present invention, an economizer refrigerant subcooling circuit is provided for enhancing operating efficiency of system 10. This refrigerant subcooling circuit includes a main refrigerant line 30 and a subcooling refrigerant line 32. Main refrigerant line 30 and subcooling refrigerant line 32 feed through an economizer heat exchanger 34, with subcooling refrigerant line 32 first passing through an expansion device 36, so that refrigerant in main refrigerant line 30 is further sub-cooled in heat exchanger 34 as desired, thereby enhancing efficiency of operation of system 10 as desired. Sub-cooled discharge from economizer heat exchanger 34 then passes to expansion device 26 and evaporator 16 as described above. Discharge from subcooling refrigerant line 32 passing through economizer heat exchanger 34 returns to compressor 12 at an economizer port 38 as shown.

In further accordance with the present invention, an evaporator air reheat circuit is also advantageously provided, and is shown in FIG. 1 as an air reheat coil 18 to which evaporator air is fed, where evaporator air is exposed to all or a portion of the liquid discharge from condenser 14, in this embodiment through air reheat refrigerant line 40.

Following air reheat heat exchanger 18, refrigerant discharge is passed through line 42 and rejoined with main refrigerant line 30 for feed to expansion device 26 and evaporator 16.

In accordance with the invention, and advantageously, evaporator air reheat allows for evaporator 16 to be operated so as to over-cool air passed therethrough. This serves to provide enhanced moisture removal from the air, with the air then being reheated to the desired temperature, thereby advantageously providing for control of humidity as desired in accordance with the present invention. This humidity control is desirable in many applications.

In further accordance with the present invention, the subcooling of refrigerant in main refrigerant line 30 provided by the economizer circuit in accordance with the present invention advantageously enhances efficiency of system 10 so as to allow for the evaporator air reheat as described above without adversely impacting overall system efficiency. Thus the resulting system as illustrated in FIG. 1 advantageously provides for efficient operation and humidity control as desired in accordance with the present invention.

Figure 1A:
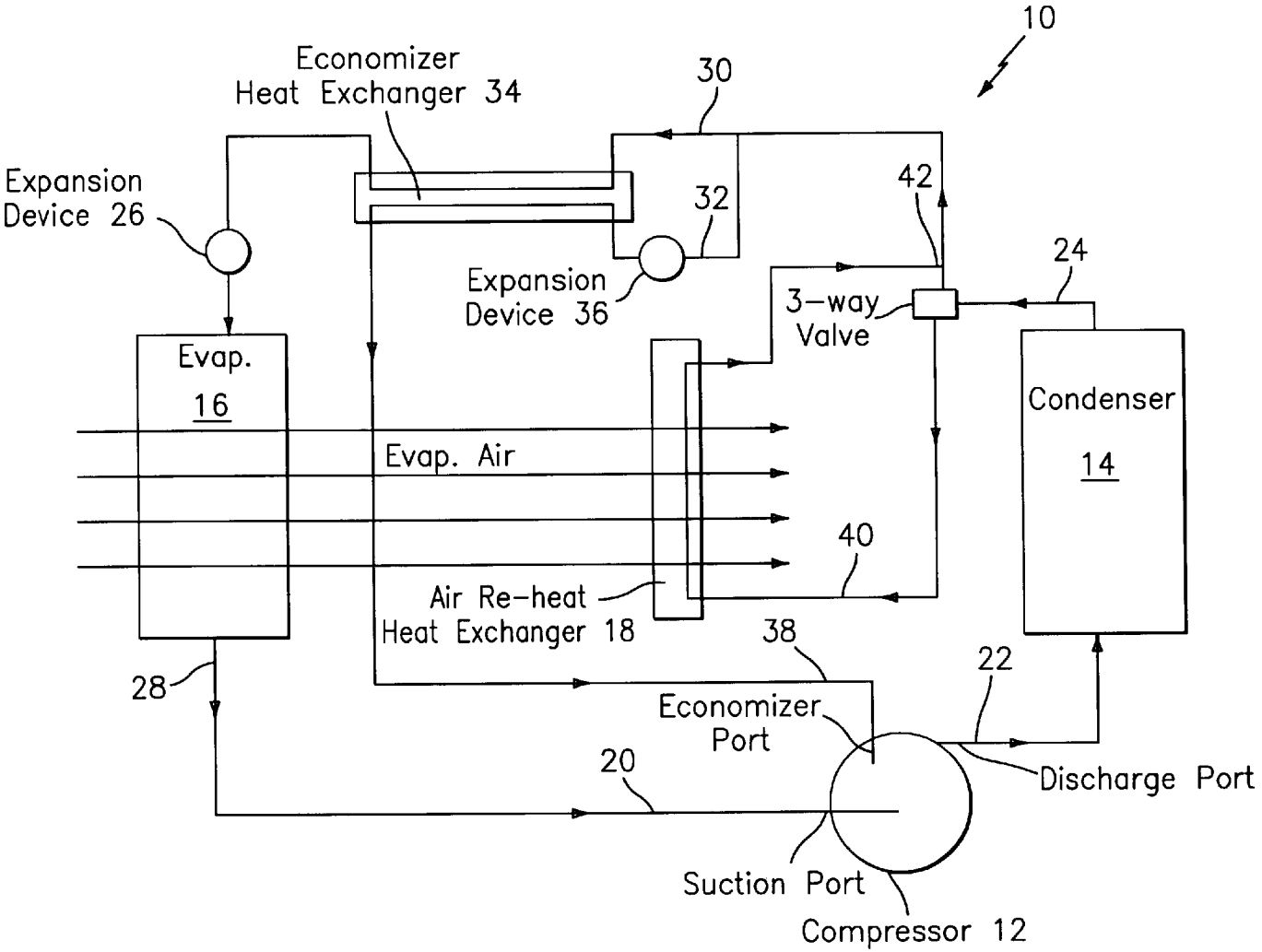
FIG. 1*a* illustrates a variation in the system of FIG. 1.

FIG. 1*a* shows an alternative embodiment to that described in connection with FIG. 1, wherein the primary difference is in connection with return of refrigerant from air reheat heat exchanger 18. In the embodiment of FIG. 1, refrigerant discharge from air reheat heat exchanger 18 is combined with refrigerant discharge from economizer heat exchanger 34 upstream of expansion device 26. In the embodiment of FIG. 1*a* refrigerant discharge from air reheat heat exchanger 18 is instead combined with refrigerant discharge from condenser 14 upstream of economizer heat exchanger 34. The embodiment of FIG. 1*a* is in all other respects identical to that of FIG. 1.

Figure 2:
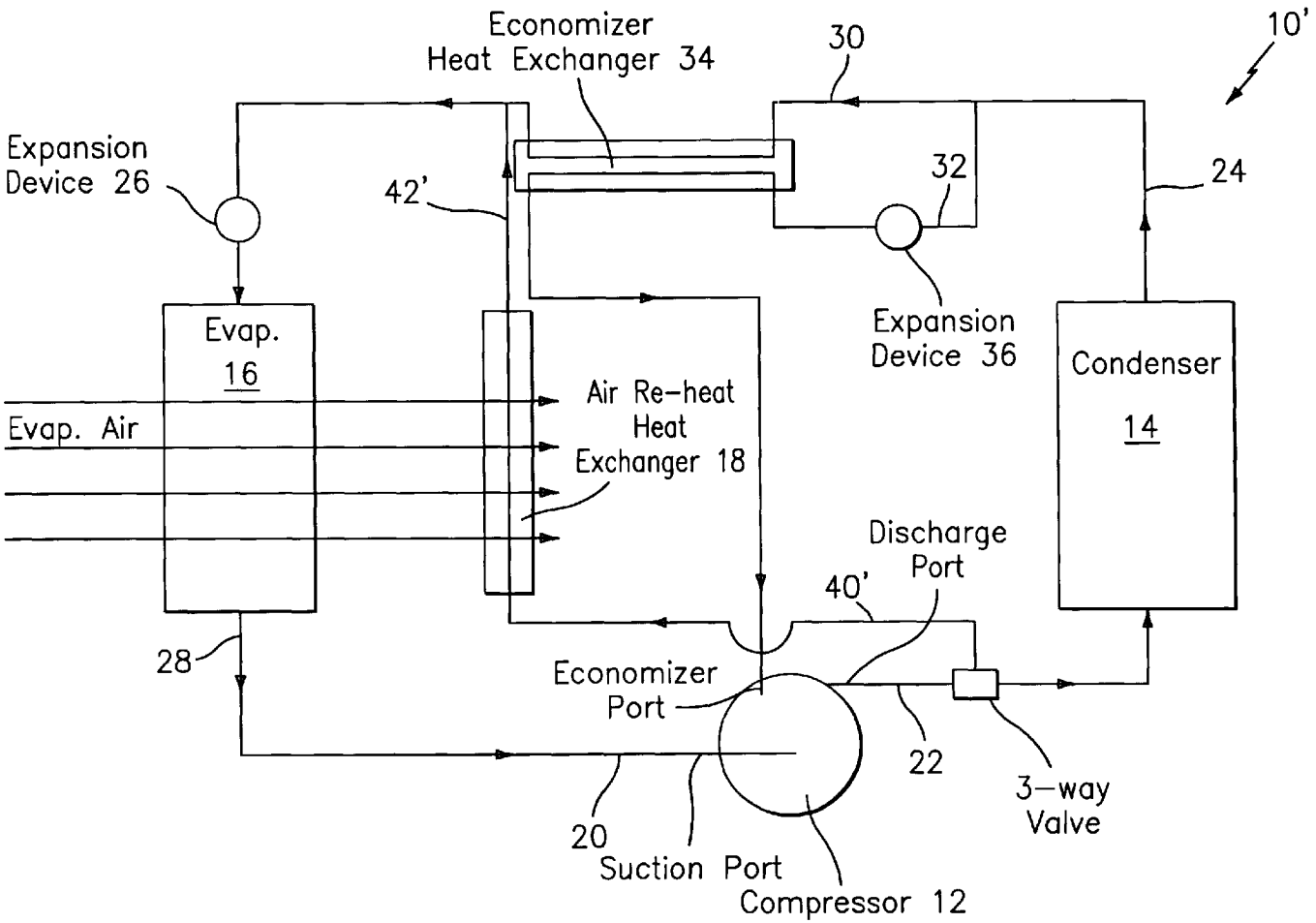
FIG. 2 illustrates an alternative embodiment of the present invention utilizing compressor discharge gas for air reheat.

Turning now to FIG. 2, an alternative embodiment of a system 10' in accordance with the present invention is illustrated. In this embodiment, system 10' includes compressor 12, condenser 14, evaporator 16 and refrigerant lines connecting same in similar fashion to that described in connection with FIG. 1. An air reheat heat exchanger 18 is also provided, as are compressor suction inlet line 20, compressor discharge line 22, condenser discharge line 24, expansion device 26 and evaporator discharge line 28. In this embodiment, an economizer refrigerant subcooling circuit is also provided, and includes main refrigerant line 30, subcooling refrigerant line 32, economizer heat exchanger 34 and expansion device 36 all as described above in connection with FIG. 1. This advantageously serves to further sub-cool refrigerant in main refrigerant line 30 as described above.

In this embodiment, however, evaporator air reheat is accomplished using a different source of heat for the air. In this embodiment, discharge gas from compressor 12 is fed through air reheat line 40' to air reheat exchanger 18 for reheating of evaporator air, and discharge from heat exchanger 18 is fed through line 42' back to be combined with an economizer discharge flow.

The economizer refrigerant subcooling circuit of this embodiment operates identically to that described in FIG. 1, and enhances system efficiency, while the evaporator air reheat circuit provides for reheating of air that has been over-cooled in evaporator 16, for humidity control purposes, as desired and also as described above in connection with FIG. 1. Thus, the embodiment of FIG. 2 also advantageously provides for efficient system operation and humidity control as desired.

Figure 2A:
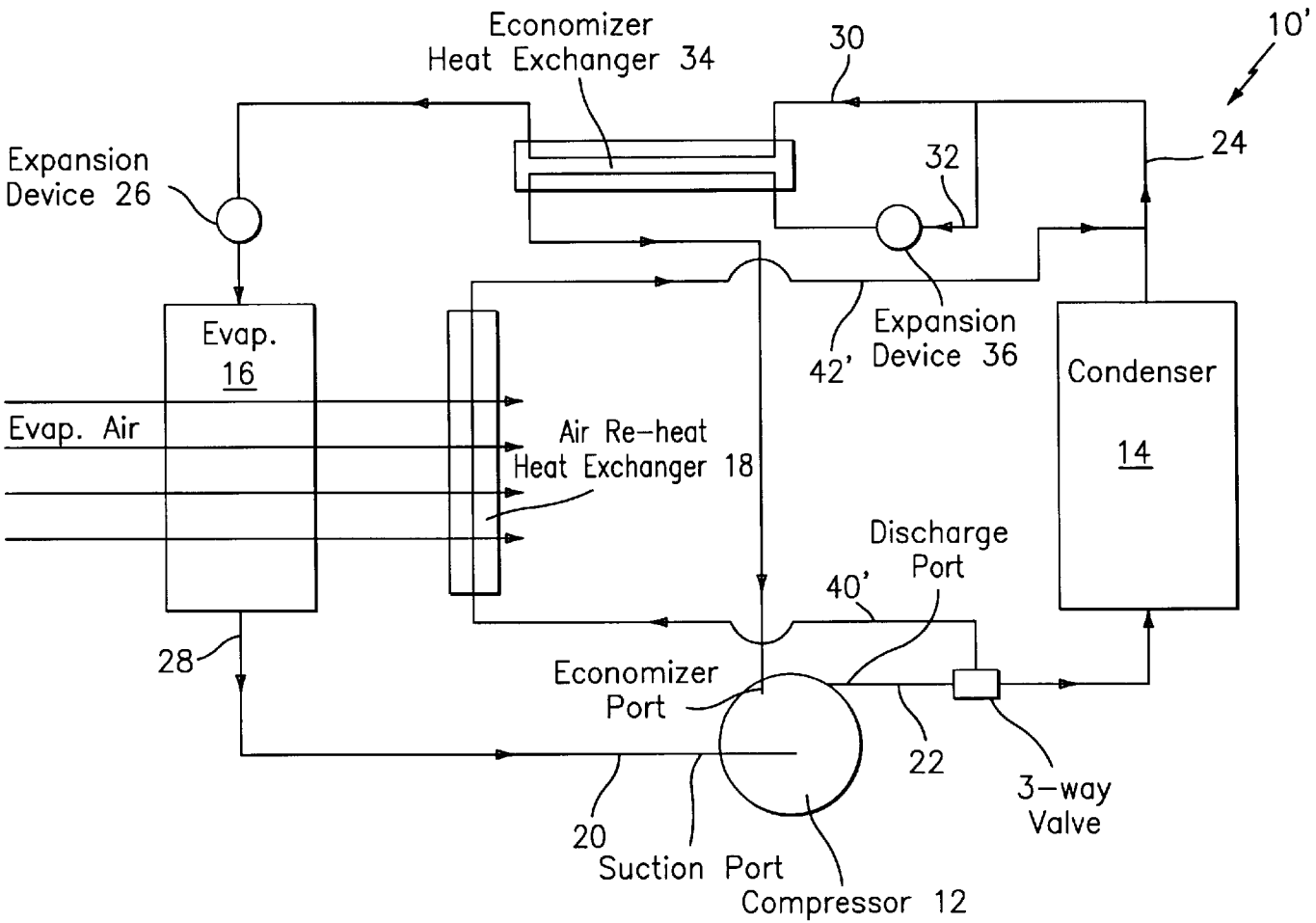
FIG. 2*a* illustrates a variation in the system of FIG. 2.

Turning now to FIG. 2*a*, an alternative embodiment to that disclosed in connection with FIG. 2 is provided. In this embodiment, refrigerant discharge from air reheat heat exchanger 18 is combined with refrigerant discharge from condenser 14 upstream of economizer heat exchanger 34, rather than combined with refrigerant discharge from economizer heat exchanger as is illustrated in the embodiment of FIG. 2. The embodiment of FIG. 2*a* is in all other respects identical to that of FIG. 2.

FIGS. 1, 1*a*, 2 and 2*a* show different configurations of a system wherein refrigerant which is warmer than over-cooled evaporator air is exposed to the evaporator air in an additional heat exchanger, in this case shown as an air reheat heat exchanger, for reheating the air after over-cooling of same. It should of course be appreciated that the re-heating can be accomplished utilizing different connections of components, and utilizing warm refrigerant, that is refrigerant which is warmer than the over-cooled air, from other locations in the system, well within the scope of the present invention.

It should also be understood that the air reheat circuit and economizer refrigerant subcooling circuit of the present invention can function simultaneously, requiring a 3-way regulating valve, or conventional cooling and dehumidification modes of operation can be executed separately requiring a 3-way shutoff valve only, at the point where warm refrigerant is separated or diverted to the air reheat circuit. In both scenarios mentioned above, the benefits of the present invention are realized.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A vapor compression system, comprising:

a vapor compression circuit comprising a compressor, a condenser, an expansion device and an evaporator communicated along refrigerant conveying lines;

an evaporator air reheat circuit communicated with said vapor compression circuit for reheating air from said evaporator; and a refrigerant subcooling circuit communicated with said vapor compression circuit for subcooling refrigerant from said condenser, whereby humidity in said air from said evaporator can be controlled while system efficiency is maintained by said refrigerant subcooling circuit, wherein said refrigerant subcooling circuit comprises an economizer heat exchanger, a main refrigerant line passing through said economizer heat exchanger and a subcooling refrigerant line passing through said heat exchanger for subcooling refrigerant in said main refrigerant line.

2. The system of claim 1, wherein said evaporator air reheat circuit comprises an air reheat heat exchanger communicated with said air from said evaporator and condenser discharge liquid for reheating said air from said evaporator.

3. The system of claim 1, wherein said evaporator air reheat circuit comprises an air reheat heat exchanger communicated with said air from said evaporator and compressor discharge gas for reheating said air from said evaporator.

4. The system of claim 1, wherein said evaporator air reheat circuit comprises an air reheat heat exchanger communicated with said air from said evaporator and condenser discharge liquid for reheating said air from said evaporator.

5. The system of claim 4, wherein refrigerant discharge from said air reheat heat exchanger is combined with refrigerant discharge from said economizer heat exchanger.

6. The system of claim 4, wherein refrigerant discharge from said air reheat heat exchanger is combined with refrigerant feed to said economizer heat exchanger.

7. The system of claim 1, wherein said evaporator air reheat circuit comprises an air reheat heat exchanger communicated with said air from said evaporator and compressor discharge gas for reheating said air from said evaporator.

8. The system of claim 7, wherein refrigerant discharge from said air reheat heat exchanger is combined with refrigerant discharge from said economizer heat exchanger.

9. The system of claim 7, wherein refrigerant discharge from said air reheat heat exchanger is combined with refrigerant feed to said economizer heat exchanger.

* * * * *